United States Patent [19]

Yen Tseng

[11] Patent Number: 5,049,127

[45] Date of Patent: Sep. 17, 1991

[54] INFANT FEEDING APPARATUS

[76] Inventor: Esther P. Yen Tseng, 775 Sutter Ave., Palo Alto, Calif. 94303

[21] Appl. No.: 500,530

[22] Filed: Mar. 26, 1990

[51] Int. Cl.[5] ..... A61J 9/00

[52] U.S. Cl. ..... 604/79; 604/261; 606/236; 215/11.1

[58] Field of Search ..... 604/48, 54, 77, 79, 604/212, 80, 92, 174, 257, 261, 262, 408; 606/234, 235, 236; 215/11.1; D24/47, 48

[56] References Cited

U.S. PATENT DOCUMENTS

| | | | |
|---|---|---|---|
| 2,969,064 | 1/1961 | Metz | 604/77 |
| 3,165,241 | 1/1965 | Curry | 604/77 |
| 4,813,933 | 3/1989 | Turner | 604/79 |
| 4,906,234 | 3/1990 | Voychehovski | 604/79 |
| 4,966,580 | 10/1990 | Turner et al. | 604/79 |

*Primary Examiner*—Stephen C. Pellegrino
*Assistant Examiner*—Glenn K. Dawson
*Attorney, Agent, or Firm*—Leon Gilden

[57] ABSTRACT

Apparatus including a vacuum packed flexible bottle containing a hook at its upper-most end for securement to a support such as a crib rail with a feed conduit directed from a lower terminal end of the container directed into a neck harness for securement about an infants neck wherein the harness includes a first tube end receiving a second tube end telescopingly therewithin to provide a safe yet secure securement about an infants neck portion with a nipple member directed through the harness for feeding of an associated infant.

2 Claims, 4 Drawing Sheets

PRIOR ART

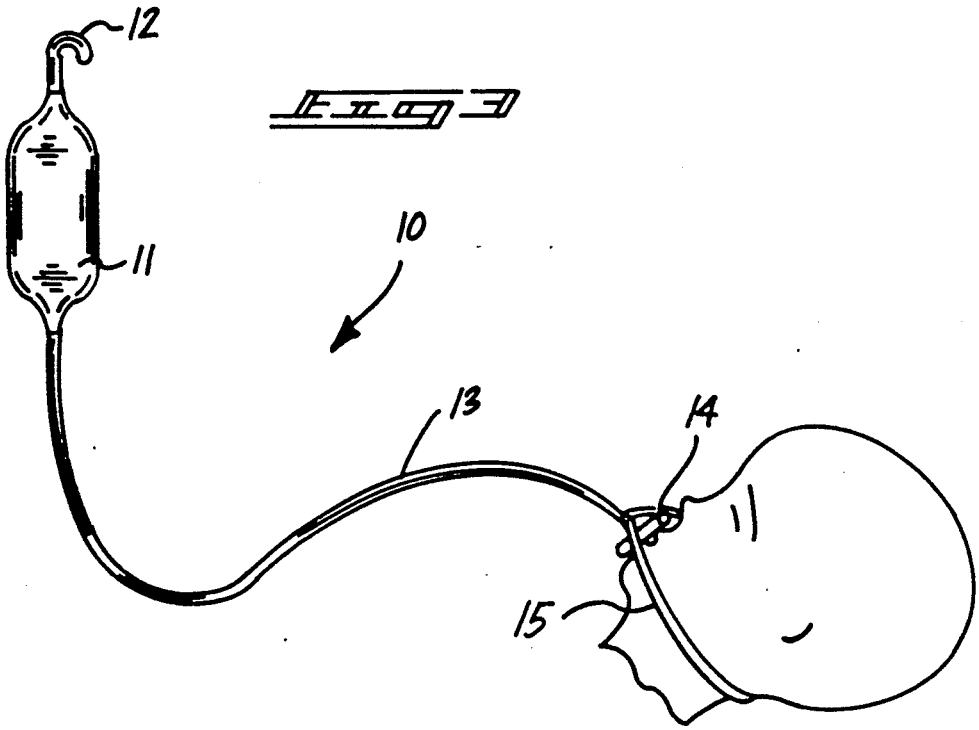
Fig 3
Fig 4
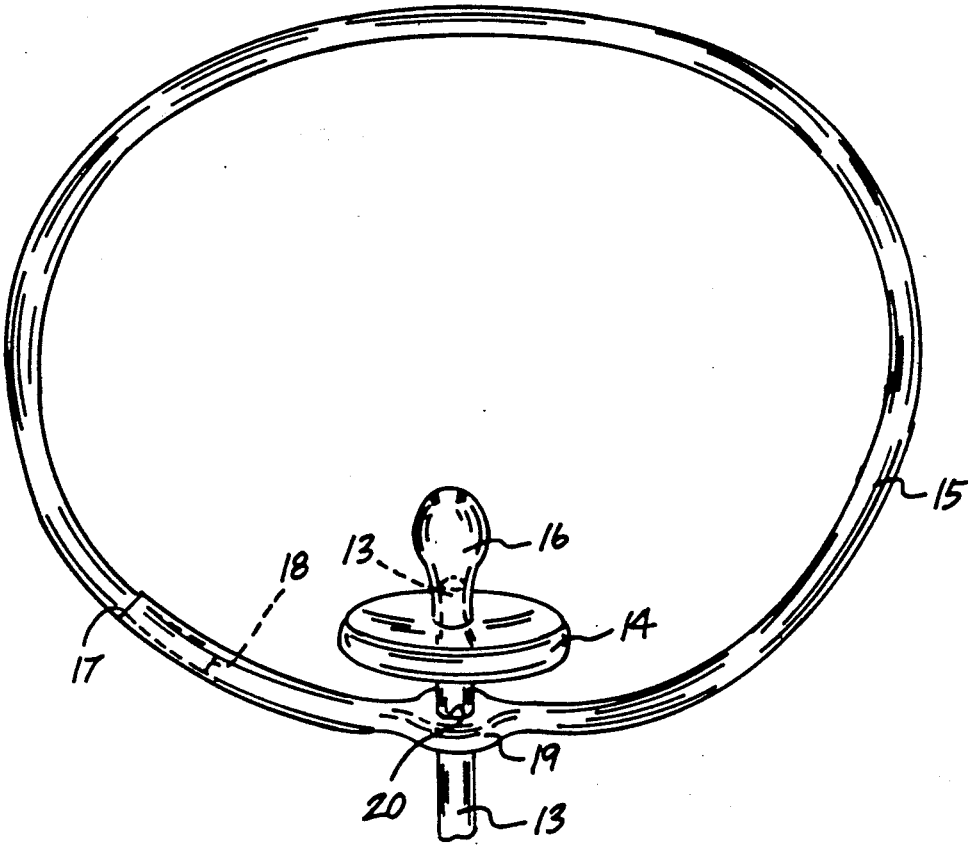

INFANT FEEDING APPARATUS

BACKGROUND OF THE INVENTION

1. Field of the invention

The field of the invention relates to infant feeding apparatus, and more particularly pertains to a new and improved infant feeding apparatus wherein the same securely yet safely mounts a baby feeding harness about an infant to be nursed.

2. Description of the Prior Art

To minimize attending time by an individual in a nursing of an associated infant, apparatus as set forth as well as in the prior art to develope an organization that may be mounted to an associated support such as a crib rail to permit an infant to nurse from a remote fluid reservoir however the prior art has failed to provide a nipple structure that may be conveniently mounted adjacent an infant's mouth to prevent the infant from losing the nipple during a feeding procedure.

Examples of the prior art include U.S. Pat. No. 2,760,664 to D'AMICO et al. wherein a rigid reservoir includes rearwardly directed hooks to secure the reservoir to a support while a single feed conduit includes a single nipple mounted thereon at a rear terminal end thereof.

U.S. Pat. No. 3,945,524 to TKACIUKAS sets forth an infant feeding organization where a bottle member supported within a bracket member mounted to a crib rail with an elongate conduit mounting a nipple at a lower terminal end for feeding of an associated infant.

U.S. Pat. No. 4,463,859 to GREENE sets forth a baby bottle feeding organization utilizing a remotely mounted reservoir and a single nipple mounted to a feed tube utilizing a flow restrictor to prevent excess flow from being directed through the nipple.

U.S. Pat. No. 3,065,873 to PLATE mounts a reservoir to a horizontal support with a nipple mounted remotely of the reservoir on a conduit.

U.S. Pat. No. 3,426,755 to CLEGG wherein a replenishable reservoir is directed through a first rigid tube into a second flexible feed conduit mounting a nipple at a remote terminal end of the feed conduit with a handle portion to permit securement of the nipple strcuture by the infant during a feeding procedure.

As such, it may be appreciated that there continues to be a need for a new and improved infant feeding apparatus wherein the same addresses both the problems of ease of use as well as effectiveness in construction in permitting a nipple to be positioned in registration with an infants mouth and in this respect, the present invention substantially fulfills this need.

SUMMARY OF THE INVENTION

In view of the foregoing disadvantages inherent in the known types of infant feeding apparatus present in the prior art, the present invention provides a new and improved infant feeding apparatus wherein the same utilizes a collar arrangement to permit securement of an infant feeding nipple thereon and position the nipple relative to an infant's mouth to enable continuous feeding by an infant. As such, the general purpose of the present invention, which will be described subsequently in greater detail, is to provide a new and improved infant feeding apparatus which has all the advantages of the prior art infant feeding apparatus and none of the disadvantages.

To attain this, the infant feeding apparatus of the invention includes apparatus including a vacuum packed flexible bottle containing a hook at its uppermost end for securement to a support such as a crib rail with a feed conduit directed from a lower terminal end of the container directed into a neck harness for securement about an infants neck wherein the harness includes a first tube end receiving a second tube end telescopingly therewithin to provide a safe yet secure securement about an infants neck portion with a nipple member directed through the harness for feeding of an associated infant. Modifications of the invention include a generally U-shaped securement strap mounting flexible straps thereto where the straps include hook and loop fasteners to mount the U-shaped strap to a forward orientation relative to an infant. The strap includes a slot for reception of a nursing nipple therethrough with a boss extending through a forward surface of the U-shaped strap to secure a spare nipple thereon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved infant feeding apparatus which has all the advantages of the prior art infant feeding apparatuses and none of the disadvantages.

It is another object of the present invention to provide a new and improved infant feeding apparatus which may be easily and efficiently manufactured and marketed.

It is a further object of the present invention to provide a new and improved infant feeding apparatus which is of a durable and reliable construction.

An even further object of the present invention is to provide a new and improved infant feeding apparatus which is susceptible of a low cost of manufacture with regard to both materials and labor, and which accordingly is then susceptible of low prices of sale to the consuming public, thereby making such infant feeding apparatuses economically available to the buying public.

Still yet another object of the present invention is to provide a new and improved infant feeding apparatus which provides in the apparatuses and methods of the prior art some of the advantages thereof, while simultaneously overcoming some of the disadvantages normally associated therewith.

Still another object of the present invention is to provide a new and improved infant feeding apparatus which may be compactly stored when not being utilized.

Yet another object of the present invention is to provide a new and improved infant feeding apparatus wherein the same permits securement of variously sized nipples to an associated feed conduit in fluid communication with a fluid reservoir and mounting the nipple in an operative association with an infant's mouth to permit continuous feeding of the infant.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the instant invention.

FIG. 4 is an isometric illustration of the infant collar utilized by the instant invention.

DESCRIPTION OF THE PREFERRED EMBODIMENT

Figure 1:
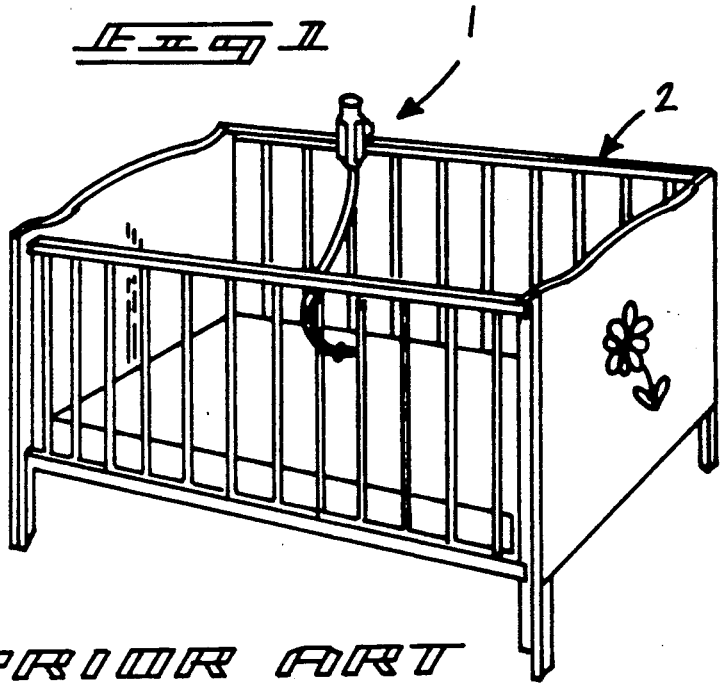
FIG. 1 is an isometric illustration of a prior art infant feeding apparatus.

With reference now to the drawings, and in particular to FIGS. 1 to 9 thereof, a new and improved infant feeding apparatus embodying the principles and concepts of the present invention and generally designated by the reference numeral 10 will be described.

Figure 2:
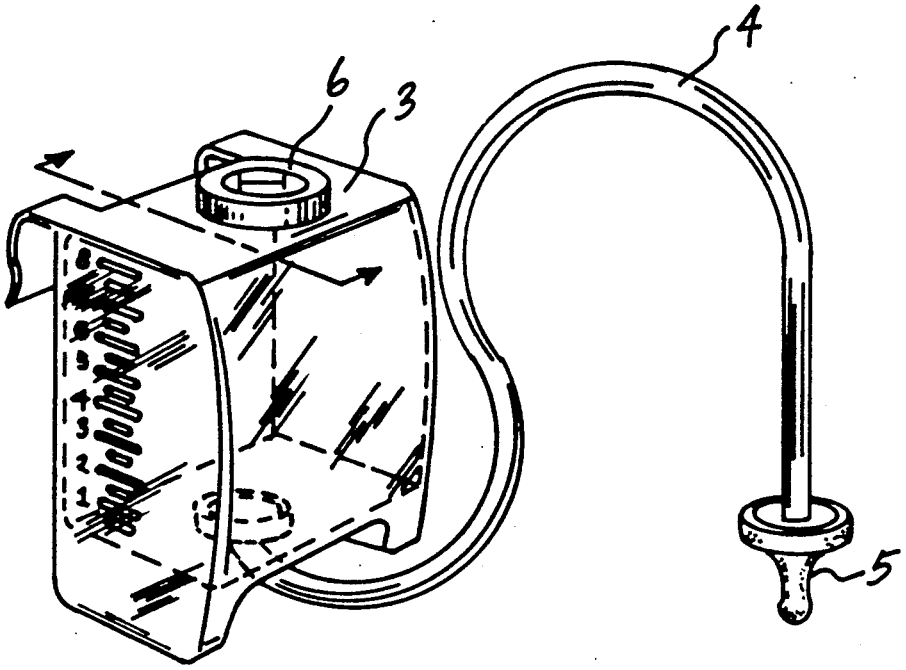
PRIOR ART FIG 2
FIG. 2 is an isometric illustration of a further prior art infant feeding apparatus.

FIG. 1 illustrates a prior art infant feeding apparatus 1 mounted to a crib rail 2 to permit an elongate conduit to extend downwardly from the reservoir for feeding of an associated infant. FIG. 2 illustrates a further infant feeding apparatus wherein a rigid reservoir 3 mounts a flexible conduit 4 and a nipple 5 at a forward terminal end thereof utilizing a fill cap 6 to permit selective replenishing of the reservoir for feeding of an associated infant.

Figure 5:
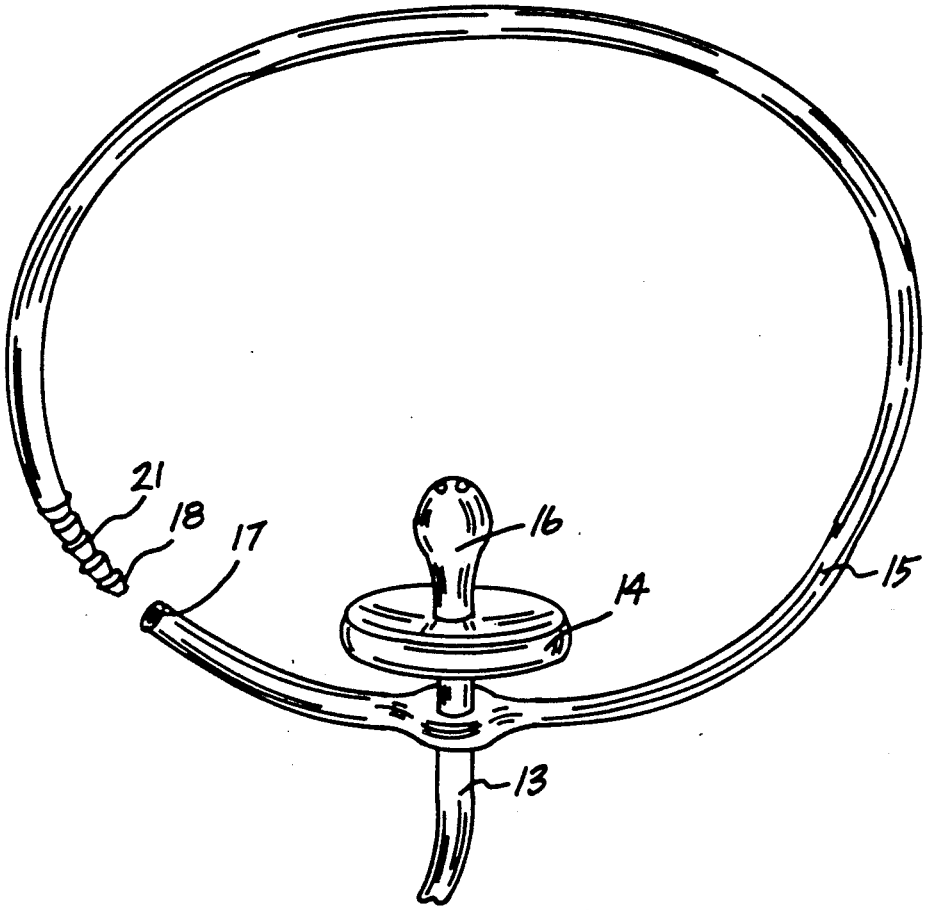
FIG. 5 is an isometric illustration of the collar arrangement of the instant invention illustrating the slide connector utilized within the collar.
Figure 6:
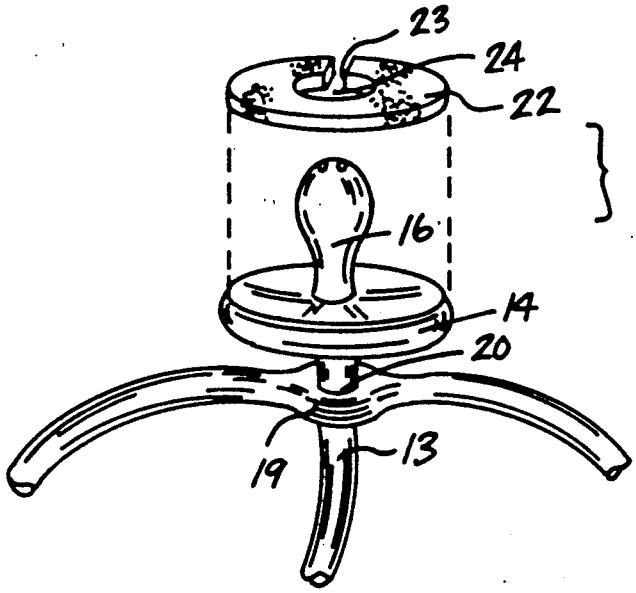
FIG. 6 is an isometric illustration of the instant invention utilizing an absorbent pad.

More specifically, the infant feeding apparatus 10 of the instant invention essentially comprises a flexible vacuum container bag 11 with a rigid hook 12 fixedly mounted at an upper terminal end thereof to permit securement of the container bag 11 to a support such as a frame rail of a crib of a type as utilized in FIG. 1. The lower terminal end of the elongate container bag 11 includes a feed conduit 13 in fluid communication with fluid contents contained within the container bag 11. The conduit 13 is defined by a requisite length to permit positioning of an associated replaceable nipple 16 mounted on a forward terminal end of the feed conduit 13 to an infant's mouth as illustrated in FIG. 3. An abutment flange 14 is coaxially positioned adjacent the nipple 16 in surrounding relationship thereto to provide an abutment preventing undue penetration of the nipple 16 within the infant's mouth. A tube loop 15 includes a first end 17 defined by a predetermined internal diameter frictionally receiving a second ends 18 of a predetermined external diameter frictionally receivable therewithin to permit adjustment of the tube loop diameter to provide adjustment and accommodation of an associated infant in positioning the nipple 16 within the infant's mouth. An enlarged securement support 19 is integrally formed within the tube loop 15 spaced from the first end 17 and includes a bore 20 formed therethrough to frictionally receive the feed conduit 13 therethrough. Reference to FIG. 5 illustrates the second end 18 including a series of conical ribbed service members 21 extending rearwardly of the second end 18 for frictional engagement of an interior surface of the tube loop 15 within the first end 17. FIG. 6 illustrates the use of an absorbent pad 22 mounted about a forward surface of the abutment flange 14 to absorb excess fluid consumed by the infant wherein the pad 22 includes a radial slot 23 and a central pad aperture 24 to permit securement of the pad about the base of the nipple 16 wherein the central aperture 24 is defined by a diameter substantially equal to the external diameter defined by the nipple 16.

Figure 7:
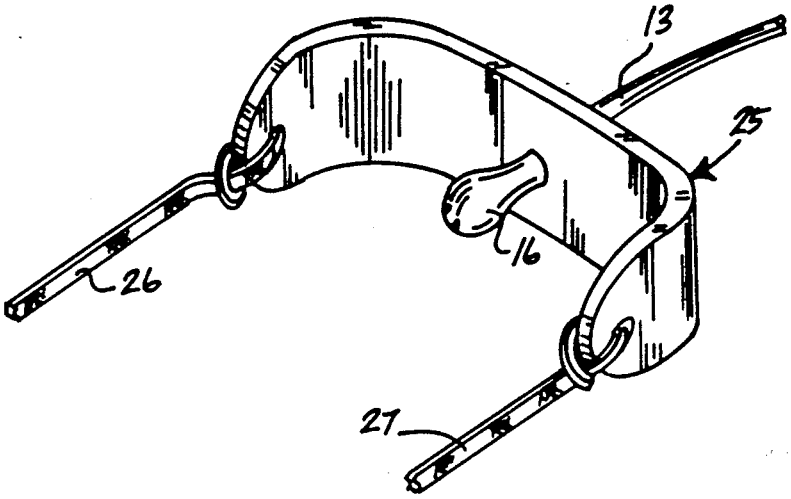
FIG. 7 is an isometric illustration of a modified collar utilized by the instant invention.

FIG. 7 illustrates a modified collar defining a U-shaped support collar 25 including the replaceable nipple 16 mounted through a bore formed within the collar 25 in fluid communication with the feed conduit 13.

Figure 8B:
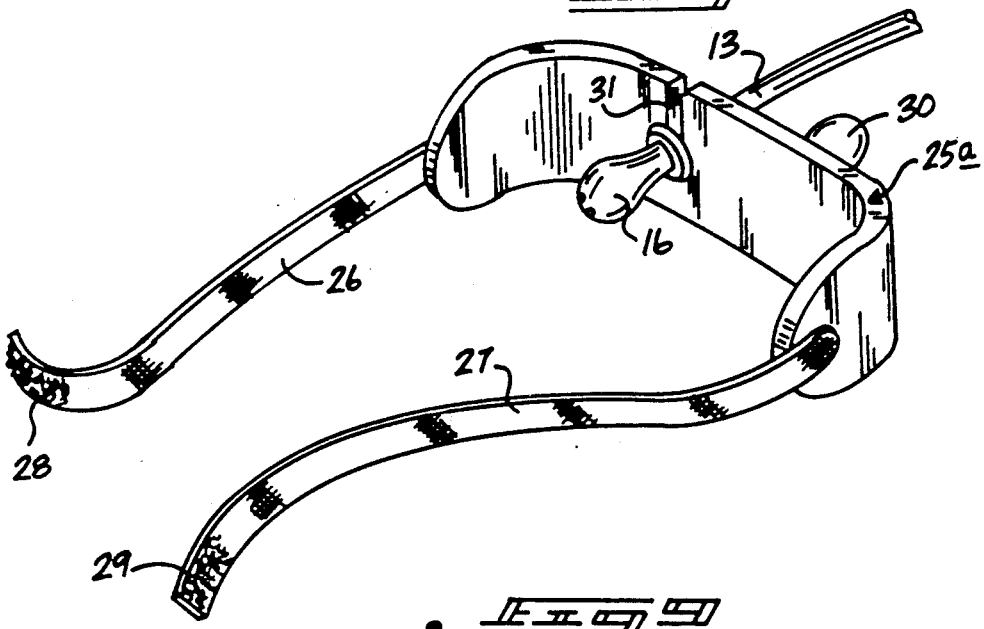
FIG. 8 is an isometric illustration of a yet further modified collar utilized by the instant invention.
Figure 9:
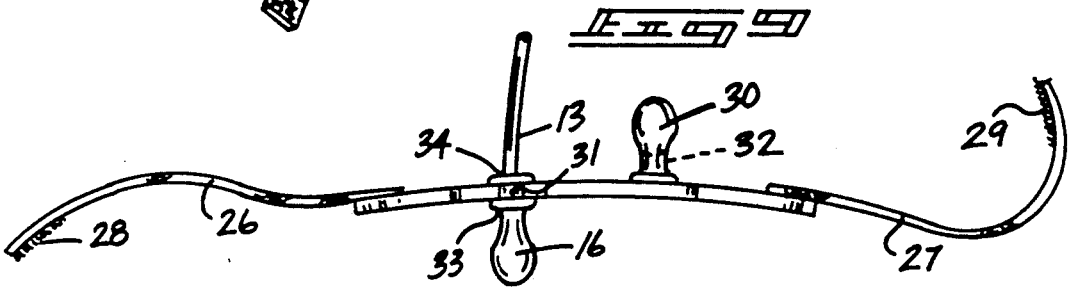
FIG. 9 is an orthographic top view of the yet further modified collar of the instant invention.

A first and second respective strap 26 and 27 is provided to position the collar in securement about the infant. Reference to FIGS. 8 and 9 illustrate a modified support collar **25*a* wherein as illustrated the first and second strap 26 and 27 use a respective first and second hook and loop fastener patch 28 and 29 selectively engageable together to permit adjustment of the straps relative to one another in securement about the infant. The replaceable nipple 16 is utilized in conjunction with a second nipple 30 that is slidably mounted upon a support boss 32 as illustrated in FIG. 9 to provide a convenient assortment of differently sized nipples for use. The nipple 16 includes a generally H-shaped resilient collar 33 formed with a central hub 34 defined by a predetermined external diameter slidably receivable within a slot 31 defined by a predetermined width substantially equal to the external diameter. The slot 31 is directed orthogonally downwardly from an upper edge of the U-shaped collar 25*a* to permit directing of the conduit 13 from a forward face of the collar that also mounts the boss 32 and the replacement nipple 30 thereon to a rear face that permits the second nipple 16** to be directed orthogonally therefrom as illustrated.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An infant feeding apparatus comprising in combination, an elongate flexible container bag, the container bag including a hook mounted at an upper terminal end thereof and a feed conduit in fluid communication with the container bag directed outwardly therefrom at a lower terminal end thereof, and the feed conduit including a forward terminal end, the forward terminal end slidably receiving a nursing nipple thereon, and the nursing nipple including an abutment flange mounted adjacent the forward terminal end of the feed conduit orthogonally disposed thereto, and the nursing nipple secured to a support collar means for securement about an infant's head to position the nursing nipple in proximity to the infant's mouth, and wherein the support collar means includes an elongate tube, the elongate tube including a first end and a second end, the first end of the tube defined by a cavity of a predetermined internal diameter, and the second end defined by a projection of a predetermined external diameter substantially equal to the predetermined internal diameter of the first end, and wherein the projection includes a series of conical ribs extending rearwardly therefrom for frictionally engaging the tube cavity of the first end, and wherein the tube further includes an enlarged support formed on the tube spaced from the first end wherein the enlarged support includes a fixed bore directed therethrough, wherein the fixed bore frictionally receives the feed conduit therethrough adjacent the forward terminal end of the feed conduit, and further including an absorbent pad selectively mounted upon the abutment flange about the nursing nipple adjacent a lower terminal end of the nursing nipple wherein the absorbent pad includes a radial slot and a central aperture to permit directing of the absorbent pad about the nursing nipple on the abutment flange.

2. An infant feeding apparatus comprising in combination, an elongate flexible container bag, the container bag including a hook mounted at an upper terminal end thereof and a feed conduit in fluid communication with the container bag directed outwardly therefrom at a lower terminal end thereof, and the feed conduit including a forward terminal end, the forward terminal end slidably receiving a nursing nipple thereon, and the nursing nipple including an abutment flange mounted adjacent the forward terminal end of the feed conduit orthogonally disposed thereto, and the nursing nipple secured to a support collar means for securement about an infant's head to position the nursing nipple in proximity to the infant's mouth, and wherein the support collar means includes a "U" shaped rigid support collar, the "U" shaped rigid support collar including a first and second flexible strap mounted at spaced ends of the "U" shaped support collar and wherein each flexible strap includes a hook and loop fastener patch mounted at each terminal end of each flexible strap, and the "U" shaped support collar including a slot directed downwardly from a top edge of the collar defined by a predetermined width, and the forward terminal end of the feed conduit including an "H" shaped resilient collar defined by a central hub wherein the hub is defined by a predetermined diameter substantially equal to the width of the slot, wherein the nursing nipple extends orthogonally relative to a rear face of the collar, and a rigid boss extends orthogonally from a forward face of the collar and a further nursing nipple is mounted on the rigid boss for selective use.

* * * * *